United States Patent [19]

Dudouyt

[11] 4,245,848

[45] Jan. 20, 1981

[54] VEHICLE EQUIPPED WITH TWO ARTICULATED TRUCKS

[76] Inventor: Jean-Paul Dudouyt, Résidence "Les Gouttettes", Rte. du Lac, Coppet, Vaud, Switzerland

[21] Appl. No.: 973,971

[22] Filed: Dec. 28, 1978

[30] Foreign Application Priority Data

| | | | |
|---|---|---|---|
| Dec. 29, 1977 | [CH] | Switzerland | 16174/74 |
| Jun. 14, 1978 | [CH] | Switzerland | 6462/78 |
| Sep. 8, 1978 | [CH] | Switzerland | 9452/78 |

[51] Int. Cl.[3] ..... A63C 1/24

[52] U.S. Cl. ..... 280/11.28; 280/87.04 A

[58] Field of Search ..... 280/87.04 A, 11.28, 280/11.19, 11.27, 87.02 R, 87.04 R

[56] References Cited

U.S. PATENT DOCUMENTS

| | | | |
|---|---|---|---|
| 2,510,722 | 6/1950 | Snyder | 280/11.28 |
| 2,552,987 | 5/1951 | Loertz, Jr. | 280/11.28 |

*Primary Examiner*—Robert R. Song
*Assistant Examiner*—Michael Mar
*Attorney, Agent, or Firm*—Edwin E. Greigg

[57] ABSTRACT

A skateboard or the like supported by two articulated steerable trucks which pivot about two non-parallel axes that are oblique with respect to the surface on which the board travels. The two pivotal axes converge to an inter-section lying below the chassis at a point lying between the two support trucks. Each of the trucks includes an articulated member holding a shaft on which wheels are mounted. In order to improve the directional stability of the skateboard, the wheel shafts of each of the two trucks lie rearward of the pivotal axes of the articulated parts of the trucks.

14 Claims, 6 Drawing Figures

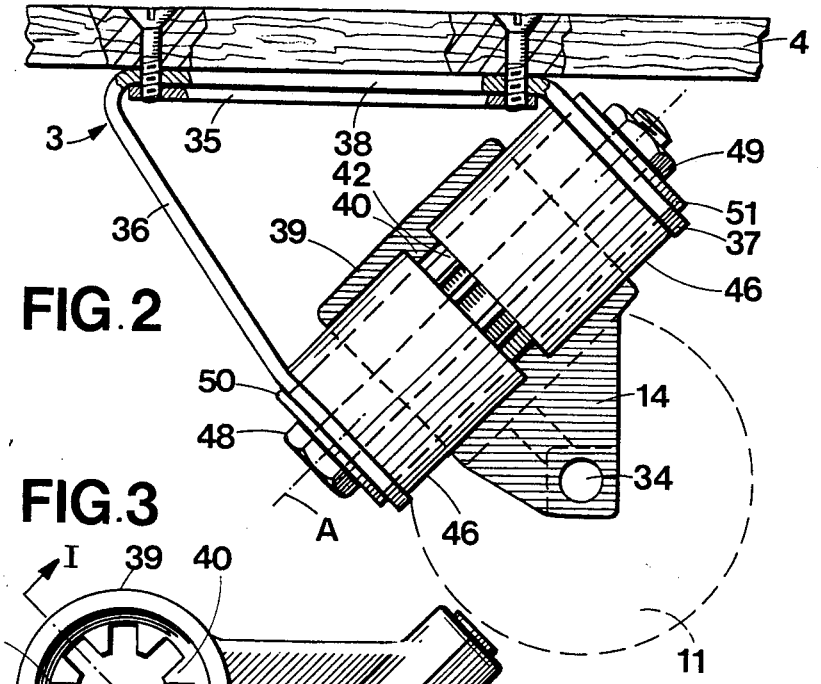
FIG. 2
FIG. 3
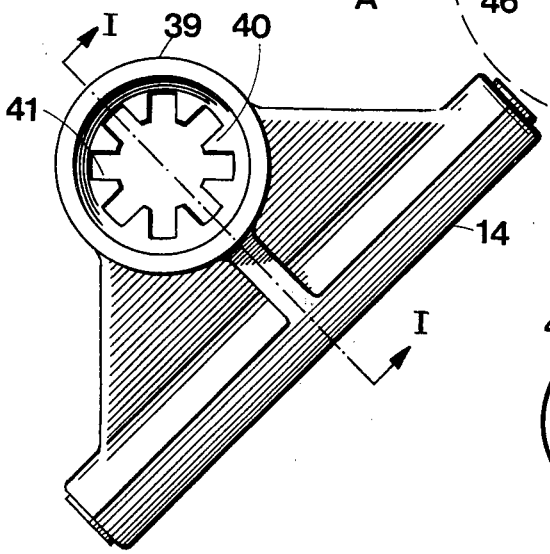
FIG. 4
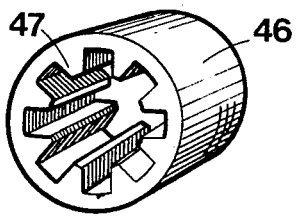
FIG. 6
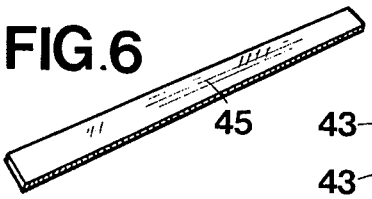
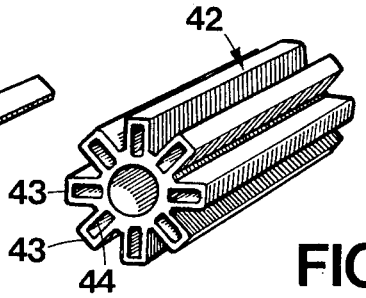
FIG. 5

VEHICLE EQUIPPED WITH TWO ARTICULATED TRUCKS

FIELD OF THE INVENTION

The invention relates to vehicles equipped with two supporting trucks which can be oriented by a lateral inclination of the entire vehicle. Each truck is solidly attached to the vehicle but may pivot about at least one axis which is oblique with respect to the plane of displacement of the vehicle.

BACKGROUND OF THE INVENTION

In the type of vehicle to which this invention relates, turns are initiated by displacing the location of the center of gravity of the vehicle user or occupant with respect to the vehicle. This displacement causes a lateral inclination of the vehicle with a corresponding change in the orientation of the truck with respect to the vehicle. Among the known vehicles of this type are the popular skateboards as well as several other types, for example steerable carts, articulated toboggans, and skateboards equipped with sails. The articulated trucks of these vehicles could also in some cases be provided with skates or sled runners or even skis instead of the wheels usually found thereon.

In the known vehicles of these types, the orientable trucks are usually identical and are placed in symmetrical manner at or near the ends of the vehicle. This manner of construction and attachment results in a directional instability of the vehicle, especially at high speed, because at least one of the trucks is pushed forward by the vehicle, its neutral center position is maintained only by the elastic return member and thus has a tendency to oscillate from one side to the other.

OBJECT AND SUMMARY OF THE INVENTION

It is thus a principal object of the invention to provide a vehicle with articulated trucks which exhibits an exceptional directional stability. This object is attained according to the invention by so constructing and attaching each truck that the mechanical frictional forces which resist the forward motion of the vehicle are applied at a point lying to the rear of the pivotal axis of the truck with respect to the direction of advance of the vehicle.

It is another object of the invention to provide a vehicle with articulated trucks which is resistant to road shocks and relatively insusceptible to damage from contact with obstacles.

The invention will be better understood as well as further objects and advantages thereof become more apparent from the ensuing detailed description of two exemplary embodiments taken in conjunction with the drawing.

BRIEF DESCRIPTION OF THE DRAWING

FIG. 2 is a partial sectional side view of one of the trucks in a second embodiment of the invention;

FIGS. 3–6 illustrate details of the truck assembly of FIG. 2.

DESCRIPTION OF THE PREFERRED EMBODIMENTS

Figure 1:
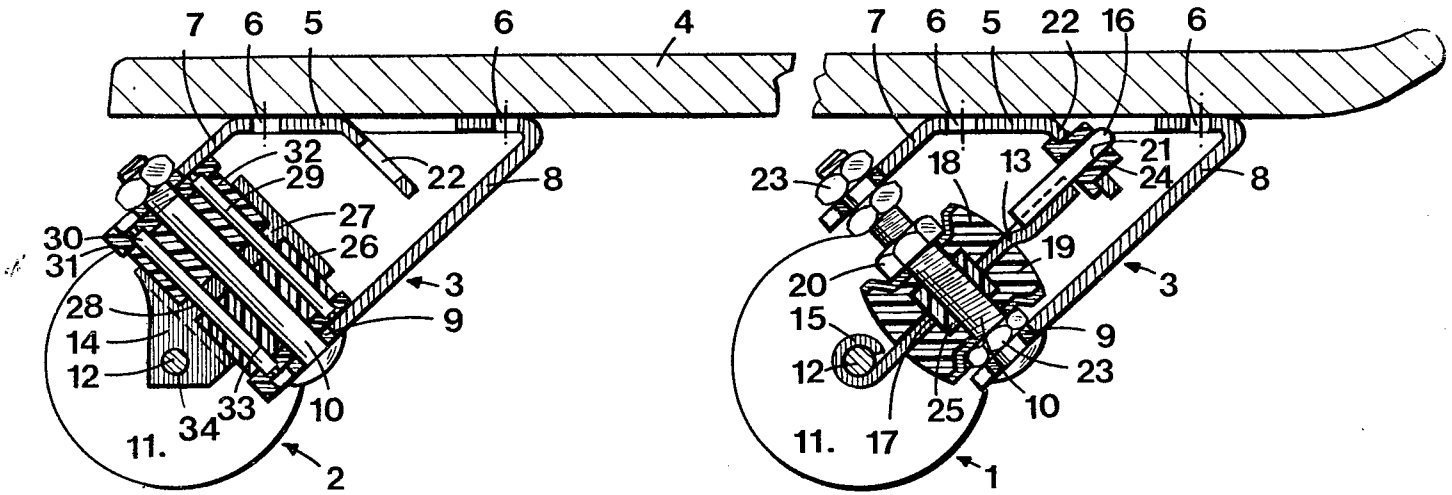
FIG. 1 is a partially sectional side view of a first embodiment of the invention illustrating a front and rear truck of a skateboard.

Turning now to FIG. 1, there will be seen a board 4, for example a skateboard, equipped with two articulated trucks, a front truck 1 and rear truck 2. The two trucks are capable of limited pivoting around two axes, both of which are inclined with respect to the plane of the board 4 and which intersect at a point lying below the board 4 and between the two trucks 1 and 2, respectively. The trucks 1 and 2 are pivotably held in support brackets 3 of identical construction and fixedly attached to the bottom of the board 4. Each of the support brackets 3 is formed by a bent metal plate which has a top surface 5 in which there are placed threaded holes 6 serving to attach the support 3 to the board 4 by means of screws and the brackets 3 further define two substantially parallel surfaces 7 and 8 extending obliquely, approximately at 45° from the plane of the central part 5 thereof. Each of the faces 7 and 8 has a hole 9, the holes 9 being aligned to receive a bolt 10 which traverses the bracket 3 and is locked in place by a nut 23.

Each of the trucks 1 and 2 is equipped in per se known manner with two wheels 11 which can rotate freely at the ends of a shaft 12 mounted in an articulating block 13 and 14, respectively. The articulating block 13 of the front truck consists of a plate 13 one end of which is bent to define a cylindrical bearing 15 which holds the shaft 12 and whose other end is welded to a cylindrical bushing 16 which is coaxial with the longitudinal axis of the plate 13.

The cylindrical bearing 15 lies to the rear of the plate 13 with respect to the forward motion of the board 4. The articulating member 13 has a hole 17 permitting the passage of the bolt 10 and is clamped between two elastic blocks 18 and 19 which in turn are clamped together by the bolt 10 and a nut 20. The bushing 16 lies in a journal 21 defined in a bent-over end portion of the central part 5 of the support bracket 3. In order to reduce friction and wear and tear, the journal 21 is defined within a sleeve 24 made, for example, from nylon and graphite and held within the bent portion 22 of the bracket 3. Guided by the bushing 16 and the bolt 10, the articulating member 13 is capable of pivoting about its own longitudinal axis thereby exerting compressive forces on the elastic blocks 18 and 19 which apply corresponding opposing forces to this pivoting and tend to hold the plate 13 in a central, neutral position.

Coaxially surrounding the bolt 10 and traversing the articulation plate 13 is a sleeve 25 constructed of an elastic material. The disposition of the sleeve 25 eliminates any metal-to-metal contact between the articulating member 13 and the bolt 10. The sleeve 25 may preferably be made of semi-elastic urethane.

The articulating member 14 of the rear truck 2 has a principal bushing 26 including a central wall 27 in which holes 28 are provided permitting the passage of, for example, four pins 29 made of spring steel. The pins 29 are placed parallel with respect to the axis of the bolt 10 and their ends are engaged in blind holes 30 located in end plates 31 fixedly attached to the surfaces 7 and 8 of the bracket 3.

Two resilient blocks 32, made for example from rubber or some synthetic elastic material, and of generally cylindrical shape are held between the central wall 27 and the end pieces 31. The elastic blocks 32 have longitudinal passages 33 in which the pins 29 are held. The assembly of the blocks 32 and the pins 29 is an elastic element permitting the principal bushing 14 to execute torsional displacements with respect to the bracket 3 and these displacements are resisted by the elastic forces exerted by the blocks 32.

A suitable opening 34 in the bushing 14 holds the wheel shaft 12 and is located to the rear of the bolt 10 with respect to the direction of forward motion of the skateboard.

The placement of the shafts 12 of the trucks 1 and 2 at the rear of the pivotal axis of the two articulated members, i.e., 13 and 14, imparts to the skateboard an exceptional directional stability. This is in part due to the fact that the two shafts 12 are pulled forward by the respective articulation members 13 or 14 and thus are located in a stable position when the skateboard is moved forward, i.e., to the right in FIG. 1.

It will be noted that the construction illustrated in FIG. 1 permits the articulated member 13 to undergo a longitudinal displacement, i.e., parallel to its longitudinal axis, thereby deforming the elastic sleeve 25. However, the articulated member 13 can also pivot around its longitudinal axis, i.e., the axis passing through the journal 21 while compressing the elastic blocks 18 and 19. The combination of elastic displacements thus permitted has a shock-absorbing effect which further improves the directional stability of the skateboard.

The sensitivity of the steering effect imparted to the articulated trucks by lateral displacements of the weight of the user can be adjusted by changing the tightness of the nut 20 which clamps the two elastic blocks 18 and 19. An advantageous feature of this embodiment is that the forward surface 8 of each of the brackets 3 protects the moving parts of the trucks 1 and 2 from shock and damage. The embodiment of the support bracket 3 as illustrated permits identically constructed brackets 3 to hold the two trucks 1 and 2 although the manner of their articulation is substantially different.

A second embodiment of the principal steering truck of a skateboard is illustrated in FIG. 2. This embodiment has an exceptionally robust construction and permits relatively easy adjustment of the elastic return forces. The embodiment illustrated in FIG. 2 shows a part of a skateboard 4 holding an articulated member 14 which has journals 34 for holding a shaft supporting, for example, two wheels 11.

The articulated member 14 pivots around an axis A with respect to the board 4. The mechanism is held by a support bracket 3 fixedly attached to the bottom of the board 4 by two screws which engage threaded holes in a mounting plate 35. The support bracket 3 is substantially U-shaped and constructed of a bent metal plate whose legs 36 and 37 are of unequal length and are both inclined with respect to the plane of the base portion 38 thereof. The articulated member 14 has a substantially cylindrical portion 39 with a central transverse wall 40 as best seen in FIG. 3. A crenelated opening 41 in the transverse wall 40 permits the passage therethrough of a tubular member 42 illustrated in FIG. 5. The tubular member 42 is made from an elastic material having, for example, eight longitudinal ribs 43. Each rib defines a hollow channel 44 in which may be placed two elastic blades 45, for example as illustrated in FIG. 6. The cross-sectional profile of the tubular member 42 is substantially equal to the crenelated opening 41 in the transverse wall 40 of the articulated member 14. Thus the tubular member 42 may be inserted in the substantially cylindrical part 39 of the member 14. The length of the blades 45 is substantially equal to that of the tubular member 42 and also substantially equal to the distance between the external faces of the legs 36 and 37 of the support bracket 3. Each of the legs 36 and 37 has a crenelated opening, similar to the opening 41 in the transverse wall 40 of the member 14. Accordingly, the tubular member 42 can engage the member 14 at its central portion by engaging the opening 41 therein as well as engage the legs 36 and 37 by engaging the crenelated holes therein.

When installed in the bracket 3, the axial position of the articulated member 14 is defined by two elastic blocks 46, illustrated in FIG. 4. The external shape of the blocks 46 is substantially cylindrical while the inside exhibits a set of longitudinal channels 47 substantially complementary to the ribs 43 of the member 42. The elements illustrated in FIGS. 2–5 are assembled in the following manner. The two spacers 46 are placed on either side of the transverse wall 40 of the member 14. This sub-assembly is then placed between the legs 36 and 37 of the bracket 3 after which the tubular member 42, the elastic blades 45 being present in the channels 44, is inserted through the crenelated opening in the leg 36 and is pushed through the member 14 and the spacer blocks 46 until it engages the opening in the leg 37 of the bracket 3. The entire assembly is then clamped in place by a coaxial bolt 48, two washers 50 and 51 and a nut 49.

The assembly described above permits a simple adjustment of the neutralizing elastic return force as must be done to adapt the vehicle to the different weights of users as well as to their differing expertise. The adjustment may be made simply by removing the bolt 48 and the washers 50 and 51 and by changing the number of elastic blades 45 within the tubular member 42. It will be appreciated that the return force will be greatest when each of the channels 44 contains two elastic blades 45. This force may be diminished by removing some of these blades. However, it is also possible to exchange the blades for others having different elasticity or thickness. It should be noted that the inclination of the leg 36 with respect to the plane of the board 4 and the substantially projection-free construction thereof completely eliminates the danger of hang-up of the articulated truck on obstacles, for example when sidewalk curbs are traversed.

The foregoing relates to preferred exemplary embodiments of the invention, it being understood that other embodiments and variants thereof are possible within the spirit and scope of the invention.

What is claimed and desired to be secured by Letters Patent of the United States is:

1. A surface vehicle comprising:

a chassis;

at least two pivotable steering and support trucks attached to said chassis, said trucks being variably pivoted by the relative inclination of said chassis with respect to said trucks, the pivotal axes of said trucks being inclined with respect to the surface on which said vehicle moves and said pivotal axes converging toward one another below said chassis, each of said trucks including an articulated member, each of said articulated members fixedly supported by said trucks, a shaft supported by said articulated member, a pair of freely rotatable wheels supported by each of said shafts, each of said shafts lying rearward of the pivotable axis of said articulated member by which it is supported wherein the point of application of frictional forces from said surfaces to said trucks lies rearward of said pivotal axes on the axis of rotation of the wheels as defined by the forward motion of said vehicle.

2. A vehicle according to claim 1, wherein each of said trucks is capable of elastic displacement parallel to its pivotal axis.

3. A vehicle according to claim 1, wherein the articulated member of the forward truck is traversed by a second pivot, substantially perpendicular to the principal pivotal axis of said articulated member, the second pivot being substantially perpendicular to the axis of said shaft of said forward truck and held in contact with said articulated member by two elastic elements, said elastic elements serving to return said articulated member to a neutral force position, and wherein said articulated member has a cylindrical end carried in an opening of said support bracket for said forward truck.

4. A vehicle according to claim 3, wherein said supports of the forward and rearward trucks are identical and define a first surface for mounting said trucks to said chassis and two bight portions extending therefrom in a direction substantially parallel to the pivotal axis of said forward articulated member.

5. A vehicle according to claim 4, wherein the articulated member of the forward truck is a plate provided with a cylindrical extension with the axis of said cylindrical extension lying in the plane of said plate.

6. A vehicle according to claim 1, in which:

said support trucks include two trucks, a forward and a rearward truck.

7. A vehicle according to claim 6, wherein the rearward truck is combined with an elastic element tending to return it into a predetermined position, and wherein said rearward truck pivots about a pivotal member coaxial with said pivotal axis, wherein said elastic element provides torsional displacement between said truck and said support bracket.

8. A vehicle according to claim 7, wherein the rearward truck includes a coaxial sleeve surrounding said pivotal member, and at least one block of elastic material disposed at the interior of said coaxial sleeve surrounding said pivotal member.

9. A vehicle according to claim 8, wherein said sleeve has an internal transverse wall, a block of elastic material placed on each side of said transverse wall, means provided for preventing a relative rotation between said transverse wall and the end face of said elastic blocks remote therefrom and further means being provided to prevent a relative displacement between the opposite end faces of said elastic blocks and the support bracket of said truck.

10. A vehicle according to claim 9, wherein said transverse wall and said elastic blocks are provided with a plurality of passages for receiving pins that are disposed in parallel with said pivotal member and serve as spring elements.

11. A vehicle according to claim 8, wherein the rearward truck includes a shaft mounted perpendicular to the pivotal axis, said shaft serving to support rotation of two wheels; whereby a plane which is perpendicular to said pivotal axis and which includes said rotational shaft intersects said sleeve off-center.

12. A vehicle according to claim 1, wherein one of said trucks includes an articulated member having a cylindrical sleeve, the ends of said cylindrical sleeve being placed between two arms of a support bracket attached to said chassis, the interior of said cylindrical sleeve including a tubular member of elastic material having internal passages for the placement therein of spring elements, and the interior of said cylindrical sleeve having lands and grooves cooperating with lands and grooves of said tubular member so as to permit relative axial displacement therebetween but preventing relative angular displacement therebetween and means for affixing said articulated member pivotably to said support bracket.

13. A vehicle according to claim 12, wherein the axial position of said articulated member is defined by at least two elastic cylindrical spacer blocks, the interior of which is provided with internal lands and grooves substantially similar to the lands and grooves in said cylindrical sleeve of said pivotable element.

14. A vehicle according to claim 12, wherein the support bracket attached to said chassis and holding said trucks is a U-shaped bracket with unequal legs substantially parallel to one another but inclined with respect to the base of said U-shaped bracket, and wherein crenelated holes are provided at the ends of each of said legs of said U-shaped bracket for fixedly holding respective ends of said tubular member.

* * * * *